US009228649B1

(12) United States Patent
Cui et al.

(10) Patent No.: US 9,228,649 B1
(45) Date of Patent: Jan. 5, 2016

(54) SIMULTANEOUS ACTUATING MECHANISM FOR PARALLEL AXIS ROTORS

(71) Applicants: Kan Cui, Mercer Island, WA (US); Margaret C. Liu, Mercer Island, WA (US); Samuel K. Liu, Mercer Island, WA (US)

(72) Inventors: Kan Cui, Mercer Island, WA (US); Margaret C. Liu, Mercer Island, WA (US); Samuel K. Liu, Mercer Island, WA (US)

( * ) Notice: Subject to any disclaimer, the term of this patent is extended or adjusted under 35 U.S.C. 154(b) by 0 days.

(21) Appl. No.: 14/637,361

(22) Filed: Mar. 3, 2015

(51) Int. Cl.
*F16H 21/12* (2006.01)
*F16H 35/18* (2006.01)

(52) U.S. Cl.
CPC ..... *F16H 35/18* (2013.01); *F16H 21/12* (2013.01)

(58) Field of Classification Search
CPC ..... F16H 21/12; F16H 35/18; Y10T 74/184
USPC ..... 74/68
See application file for complete search history.

(56) References Cited

U.S. PATENT DOCUMENTS

| | | | | |
|---|---|---|---|---|
| 93,004 | A * | 7/1869 | Read | 74/67 |
| 584,130 | A * | 6/1897 | Griswold | 123/54.2 |
| 1,392,597 | A * | 10/1921 | Ricardo | 123/90.31 |
| 1,971,885 | A * | 8/1934 | Viale | 74/68 |
| 3,198,028 | A * | 8/1965 | Dahl et al. | 74/409 |
| 3,433,083 | A * | 3/1969 | Pope et al. | 74/68 |
| 7,836,796 | B2 | 11/2010 | Chang | |
| 2002/0117027 | A1 | 8/2002 | Boston | |
| 2011/0265611 | A1 | 11/2011 | Raman | |

FOREIGN PATENT DOCUMENTS

| | | |
|---|---|---|
| JP | 2013-119783 | 6/2013 |
| KR | 10-2006-055649 | 5/2006 |

* cited by examiner

*Primary Examiner* — William C Joyce
(74) *Attorney, Agent, or Firm* — Richard C. Litman

(57) ABSTRACT

The simultaneous actuating mechanism for parallel axis rotors includes a base and a plurality of rotating rotors mounted in spaced relation inside the base, the rotors having parallel axes of rotation. A crank pin extends from each rotor at a position offset from the corresponding axis of rotation. A driving assembly is coupled to the crank pin of all the rotors. Operation of the driving assembly causes simultaneous rotation of the rotors to facilitate various mechanical functions, such as threading, steering, and reciprocation of multiple elements.

8 Claims, 8 Drawing Sheets

SIMULTANEOUS ACTUATING MECHANISM FOR PARALLEL AXIS ROTORS

BACKGROUND OF THE INVENTION

1. Field of the Invention

The present invention relates to mechanical actuators, and particularly to a simultaneous actuating mechanism for parallel axis rotors that drives or rotates a plurality of spaced rotors at the same time without employing intermediate, motion-transferring components between the rotors.

2. Description of the Related Art

One of the most fundamental aspects of mechanical systems is power transfer, usually from rotary motion into working motion. Most common mechanical systems include a rotary driver connected to a plurality of other components that need to be powered by the driver. The components are typically interconnected by intermediate components, such as gears, pinions, pulleys, belts, chains, and the like, prior to performing actual work. Depending on the complexity of these mechanical systems, the power transfer can be inefficient, simply from the physics of attempting to move multiple components from a single source or input. In other words, for a given amount of rotary power, the output power for work can be significantly reduced due to the energy loss in moving the intermediary components. Additionally, a complex mechanical system with numerous parts generally tends to be more prone to requiring servicing and maintenance, since there are more parts that can potentially wear out or fail.

Thus, a simultaneous actuating mechanism for parallel axis rotors solving the aforementioned problems is desired.

SUMMARY OF THE INVENTION

The simultaneous actuating mechanism for parallel axis rotors includes a base and a plurality of rotating rotors mounted in spaced relation inside the base such that the axis of rotation for each rotor is parallel to each other. A crank pin extends from each rotor at a position offset from the corresponding axis of rotation. A driving assembly is coupled to the crank pin of all the rotors. Operation of the driving assembly causes simultaneous rotation of the rotors to facilitate various mechanical functions, such as threading, steering, and reciprocation of multiple elements.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
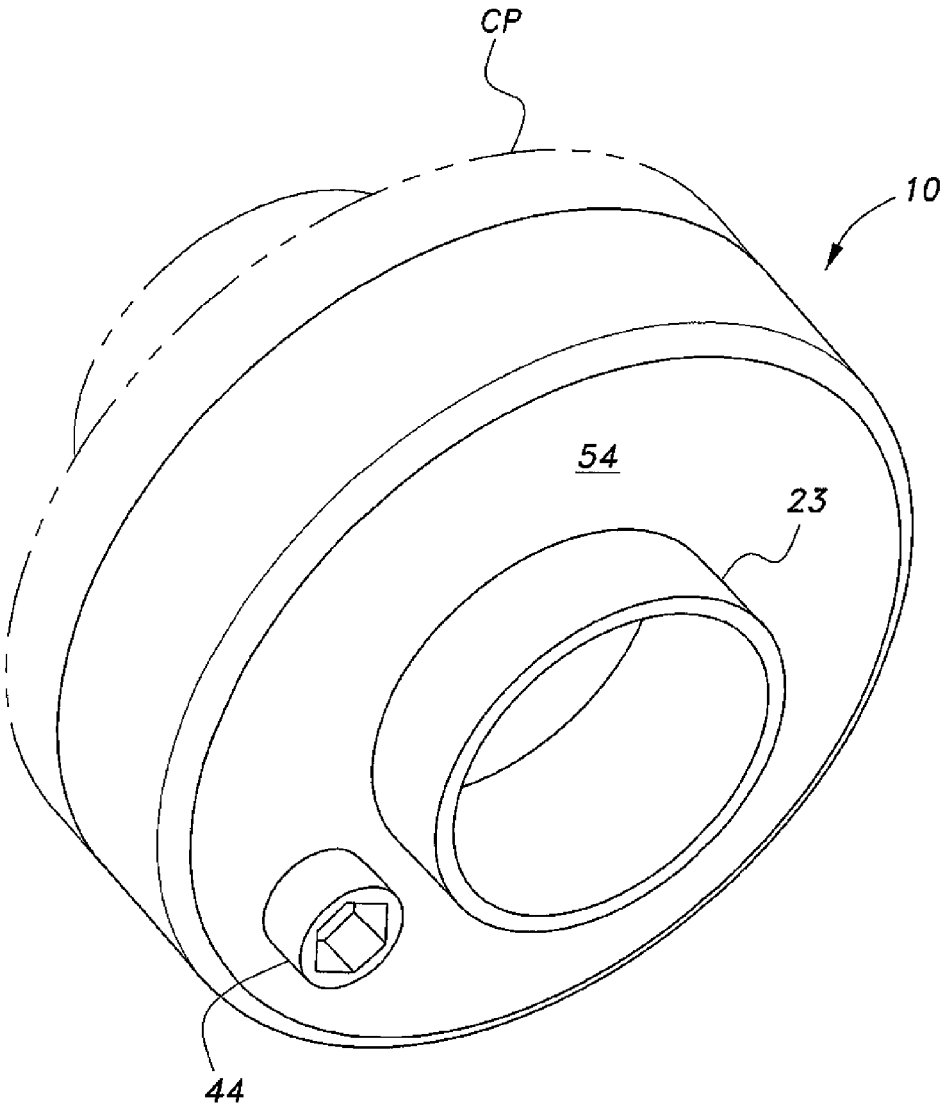
FIG. 1 is an environmental, perspective view of a first embodiment of a simultaneous actuating mechanism for parallel axis rotors according to the present invention.
Figure 2:
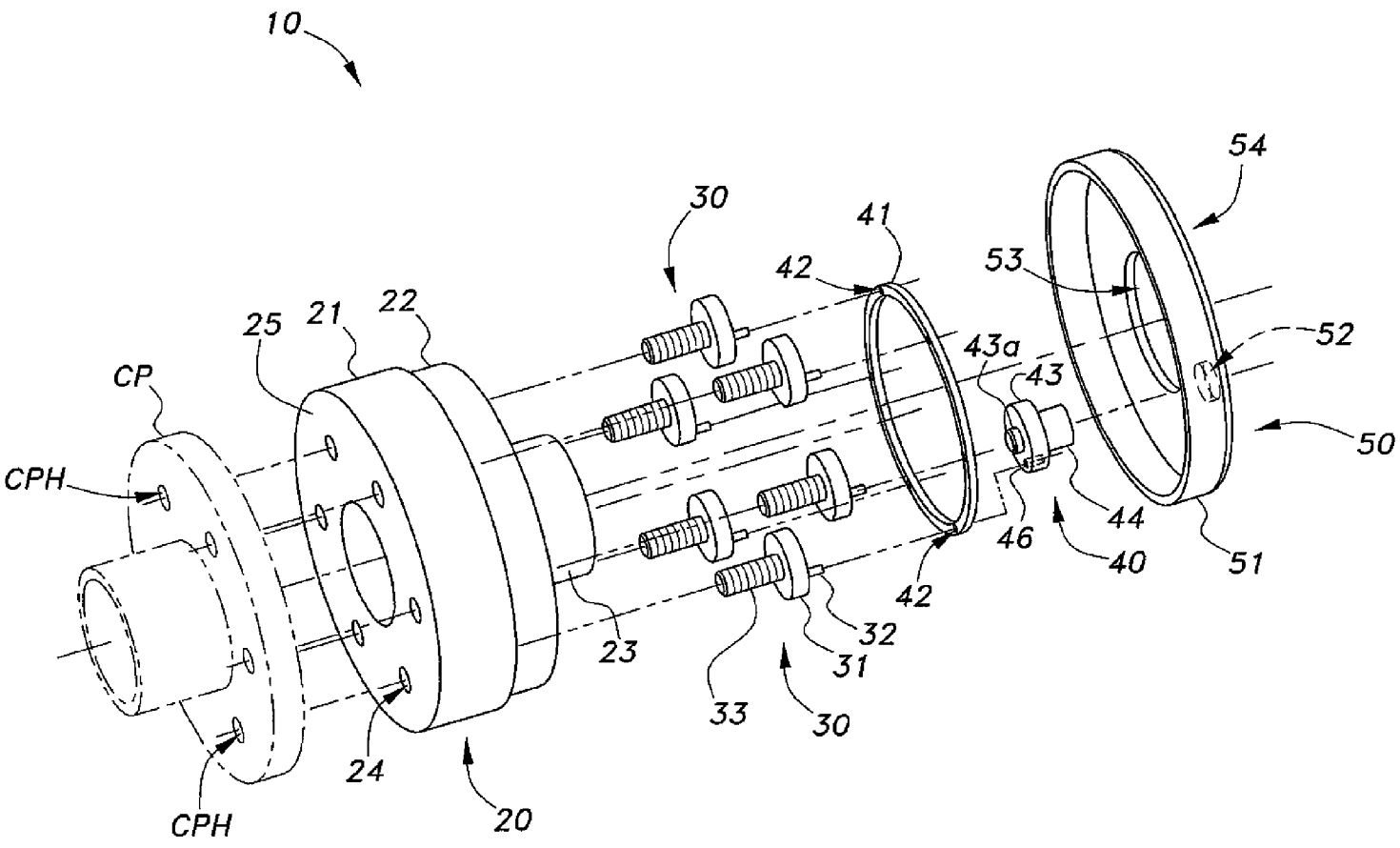
FIG. 2 is an exploded perspective view of the simultaneous actuating mechanism for parallel axis rotors of FIG. 1 as seen from the rear of the device.
Figure 3:
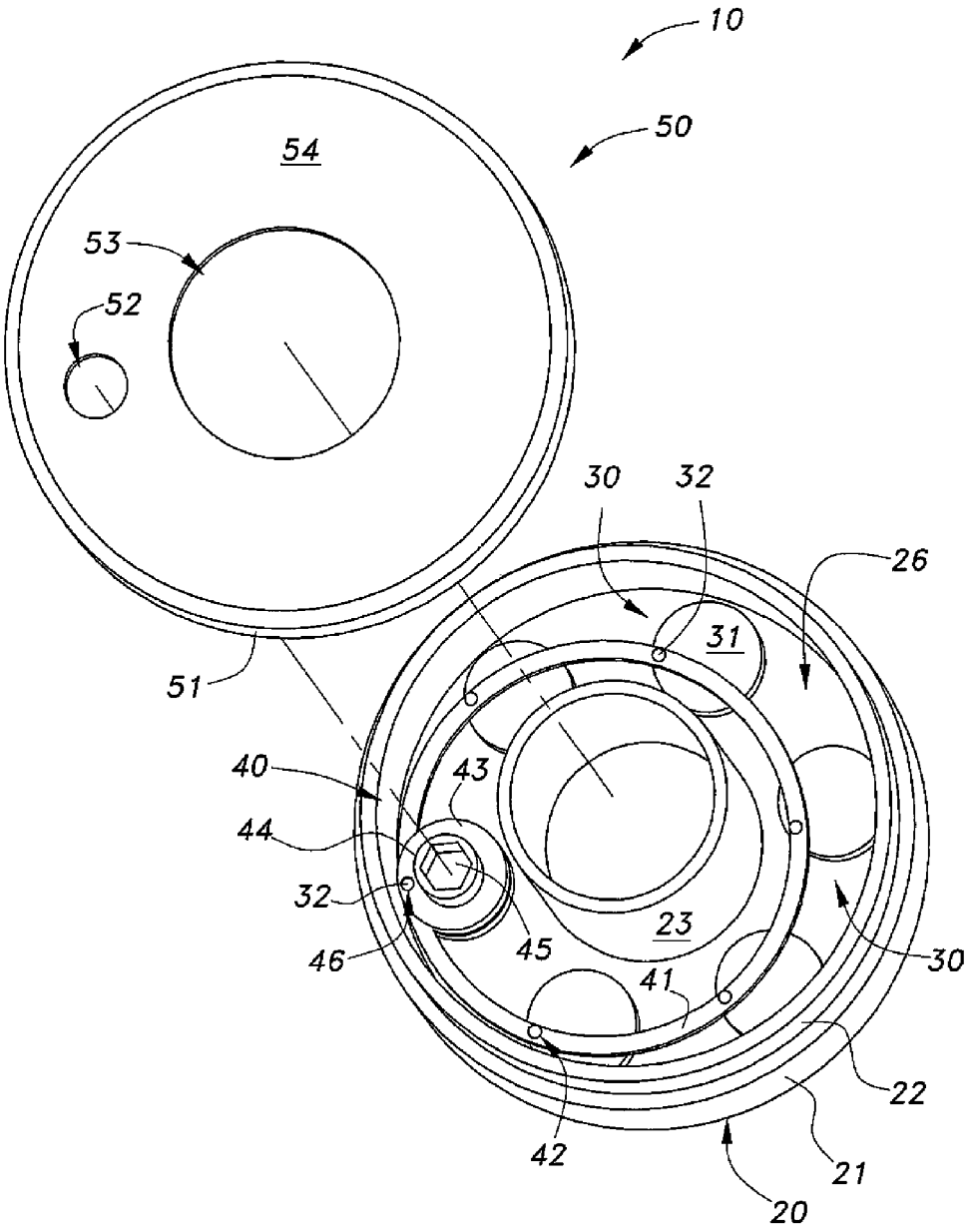
FIG. 3 is a partially exploded perspective view of the simultaneous actuating mechanism for parallel axis rotors of FIG. 1 as seen from the front of the device.

The simultaneous actuating mechanism for parallel axis rotors, a first embodiment of which is generally referred to by the reference number 10 in the drawings, provides a mechanical configuration to drive a plurality of rotors arranged along various parallel axes of rotation with minimal parts. As best seen in FIGS. 1-3, the simultaneous actuator 10 includes a housing 20, a plurality of rotors 30 rotatably mounted inside the housing 20, a driving assembly 40 coupled to the rotors 30 to drive the rotors 30 simultaneously, and a cap 50 detachably mounted to the housing 20. In the embodiment shown in FIGS. 1-3, the simultaneous actuator 10 is configured to drive a plurality of bolts at the same time to selectively connect or disconnect mechanical parts, for example to cover the open end of a pipe or mount a wheel to a hub.

The housing 20 is constructed as a generally hollow, cylindrical shell having a generally closed base 25 at one end of the housing 20 and an outer wall 21 extending from the base 25. The opposite end of the housing 20 is open. The outer wall 21 is generally circular to define the shape of the housing 20.

The housing 20 can be provided with an elongate, hollow central hub 23 extending axially from the center of the base 25. The central hub 23 is configured as a hollow cylinder, preferably having a length greater than the height of the outer wall 21. The space between the outer wall 21 and the central hub 23 forms an annular recess 26 inside the housing 20 where the plurality of rotors 30 can be placed at predetermined or predefined locations within the annular recess 26. The central hub 23 serves as a mounting post for the cap 50 and/or as a pass-through opening for other components.

Each rotor 30 includes a generally flat crank head 31, an elongate, offset crank pin 32 extending from one side of the crank head 31, and an elongate engagement post 33 extending from the opposite side of the crank head 31. Each crank head 31 is preferably constructed as a circular disk. However, the crank head 31 can be provided in various shapes, so long as the crank head 31 can facilitate rotation of the engagement post 33 vis-à-vis interaction of the crank pin 32. The engagement post 33 defines the axis of rotation for each rotor 30, and the rotors 30 are arranged within the annular recess 26 in any desired spaced relation so that the respective engagement post 33 passes through a corresponding opening or through-hole 24 on the base 25 of the housing 20. It can be seen from FIG. 2 that this arrangement positions the rotors 30 in spaced, parallel axes of rotation with respect to each other. While the spacing between the rotors 30 can be set at any arbitrary manner, e.g., regular or irregular intervals, the spacing or distance between at least one adjacent pair of rotors 30 should be constant for connecting with the driving assembly 40 and operation therefrom.

The driving assembly 40 facilitates concurrent rotation or actuation of all the rotors 30 inside the housing 20. The driving assembly 40 includes a driver 41 having a plurality of driver holes 42 formed therein. The driver 41 may be constructed as an annular ring having a diameter sized to fit inside the annular recess 26 and over the central hub 23. The size of the annular ring permits the annular ring to orbit about the central hub 23 while being confined inside the annular recess 26. Each driver hole 42 is sized to receive a respective crank pin 32 therein when assembled. The crank pin 32 of each rotor 30 is placed at an offset from the axis of rotation of the corresponding rotor 30. Thus, when assembled, the orbital movement of the driver 41 about the central hub 23 forces all the connected crank pins 32 to rotate the respective rotor 30.

The driving assembly 40 includes a power assembly, such as a driver nut 43, to power the driver 41. An engagement boss 43*a* extends from the bottom of the driver nut 43 and a tool boss 44 extends from the top of the driver nut 43. A through-hole 46 extends into or through the driver nut 43. The engagement boss 43*a* is configured to abut against the inner circumference of the driver 41, while the through-hole 46 captures one of the crank pins 32 on a corresponding rotor 30. The length or thickness of the engagement boss 43*a* is preferably of the same thickness as the driver 41 so that the surrounding bottom surface of the driver nut 43 lies flush against the top of the annular driver 41 during use and operation. Thus, the difference between the smaller dimensions of the engagement boss 43*a* and the larger dimensions of the bottom of the driver nut 43 forms a ledge that rides on top of the annular driver 41. The tool boss 44 includes a tool recess 45 for selective insertion and operation of a tool (not shown). The tool can be a manual or motorized hex-head wrench and the like.

The cap 50 is configured to cover the housing 20 with the rotors 30 and the driving assembly 40 mounted therein. The cap 50 may be constructed as a generally hollow, cylindrical shell having a generally closed upper wall 54 at one end of the cap 20 and an outer wall 51 extending from upper wall 54. The opposite end of the cap 50 is open. The outer wall 51 is generally circular to define the shape of the cap 50. An upper flange 22 extends upward from the top of the outer wall 21 of the housing 20, and the outer wall 51 securely engages the upper flange 22 when assembled.

The cap 50 can also include a central bore 53 sized to slide over the central hub 23 in order to permit the central hub 23 to protrude out of the cap 50 when assembled. A driver access hole or opening 52 is formed on the upper wall 54. The driver access hole 52 is preferably dimensioned to fit around the tool boss 44 and permit access thereto for the tool. The height or length of the tool boss 44 can be suitably long enough to be flush with the top surface of the upper wall 54 or protrude out of the cap 50 a desired distance.

In use, operation of the driver nut 43 with the tool to rotate the driver nut 43 forces the driver 41 to orbit about the central hub 23. Since the crank pins 32 on all the rotors 30 are connected to the driver 41 through the respective driver holes 42, the orbiting motion of the driver 41 causes simultaneous rotation of all the rotors 30. Thus, the driver 41 acts as a universal crank driving all the rotors 30. The engagement posts 33 can be threaded so that they function as threaded bolts for connecting the simultaneous actuator 10 to a component part CP through engagement with corresponding holes CPH. This arrangement can facilitate simultaneous bolting of parts and provides for many various applications. For example, the simultaneous actuator 10 can be used as a cap end for enclosed cases, a wheel bolting mechanism for bolting a wheel onto an axle, or an end connection for pipelines.

For proper simultaneous operation of the rotors 30, at least a pair of adjacent rotors 30 should have a constant spaced distance between the axis of rotation of the pair. As long as this constant distance is maintained, the spacing among the remaining rotors 30 can be set at any desired distance. The crank distance (or the distance between the axis of rotation and the crank pin 32) for each rotor 30 should also be the same. So long as the above two conditions are met, the construction of the rotors 30 can be widely varied. In other words, the shape and function of individual rotors 30 can be different from other rotors 30 within the same simultaneous actuator 10. The rotors 30 do not need to be of the same configuration as shown in the drawings.

Additionally, the above description shows that simultaneous operation of the rotors 30 can be achieved by driving only one of the rotors 30, e.g., the direct connection between the driver nut 43 and one of the rotors 30. However, it is also recognized that additional rotors 30 can be driven independently with suitable modifications.

Figure 4:
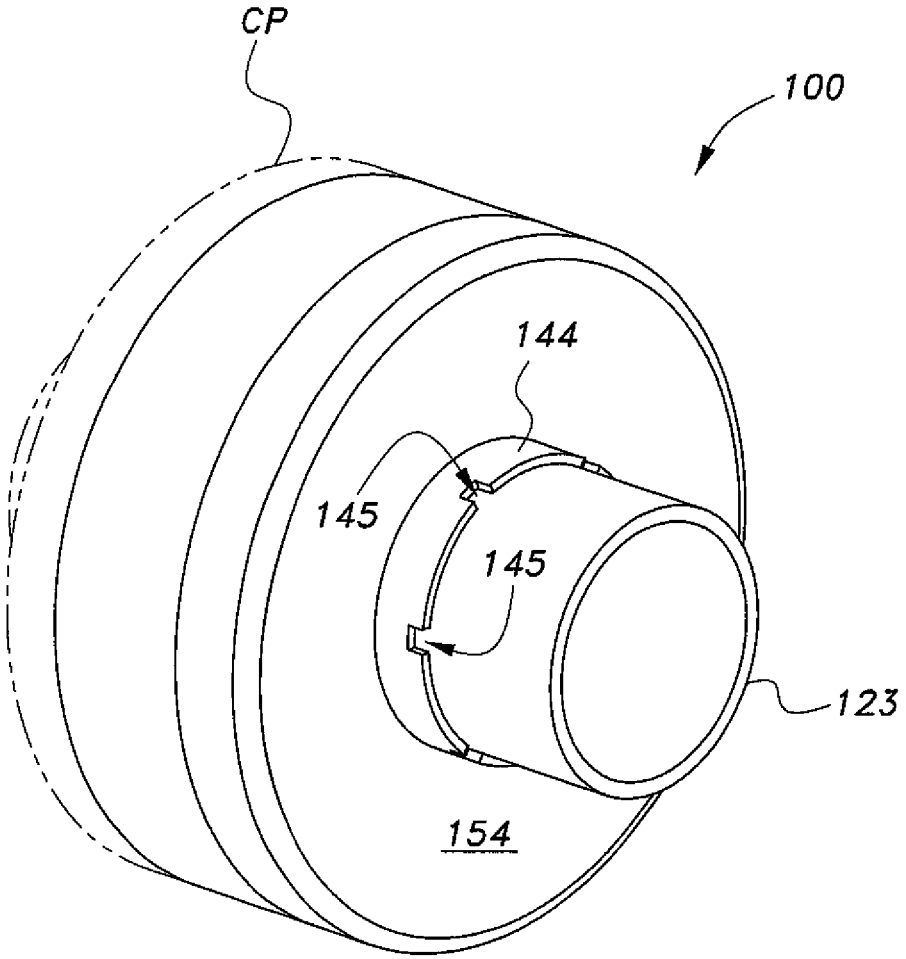
FIG. 4 is a perspective view of a second embodiment of a simultaneous actuating mechanism for parallel axis rotors according to the present invention.
Figure 5:
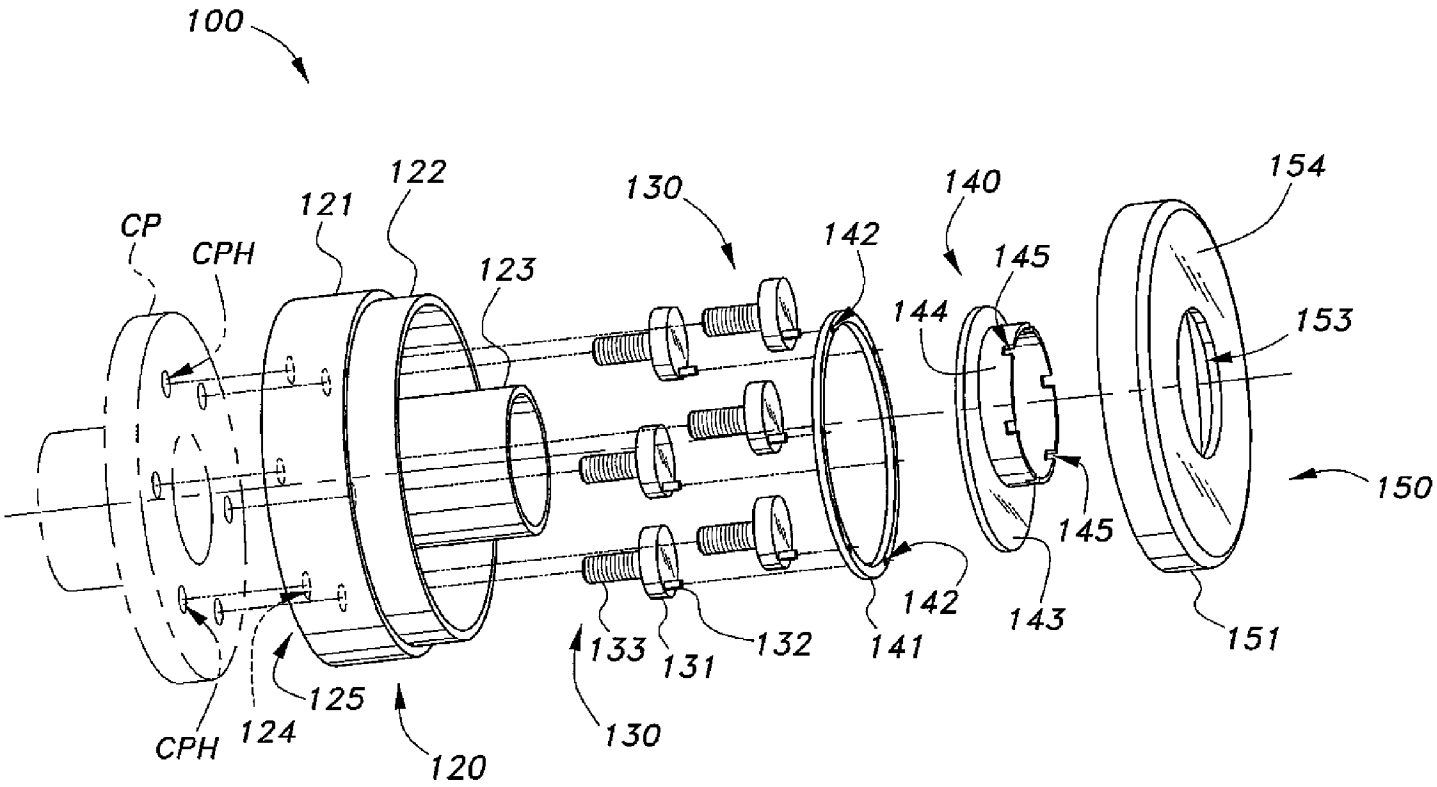
FIG. 5 is an exploded perspective view of the simultaneous actuating mechanism for parallel axis rotors of FIG. 4.
Figure 6:
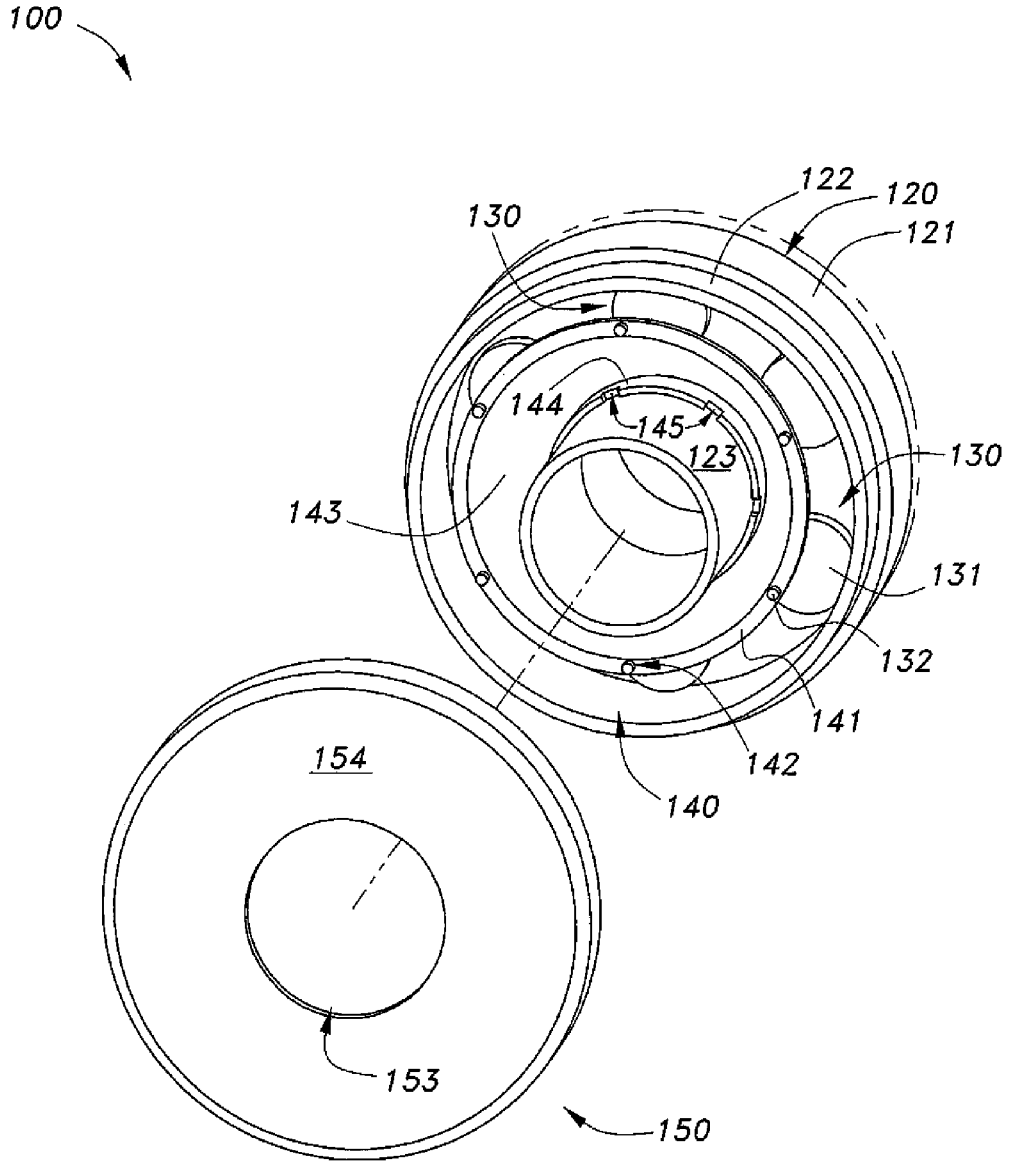
FIG. 6 is a partially exploded perspective view of the simultaneous actuating mechanism for parallel axis rotors of FIG. 4.

A second embodiment of a simultaneous actuator 100 for parallel axis rotors is shown in FIGS. 4-6. In this embodiment, the simultaneous actuator 100 is substantially the same in construction and function as the simultaneous actuator 10, except for a driving assembly 140. The following description will mainly be directed towards the driving assembly 140 for brevity. Common features are designated by similar reference numbers in the "100" series unless indicated otherwise.

The driving assembly 140 is configured to simplify operation of the simultaneous actuator 100 by eliminating some of the difficulty in using common tools, such as a wrench or screwdriver, on a corresponding nut located at an off-center or off-axis location to drive the rotors, for example, the offset location of the tool boss 44 in the simultaneous actuator 10. The driving assembly 140 includes a power assembly, such as a driver disk 143 configured to seat inside the annular driver 141, and includes a throughbore offset from the center of the driver disk 143. A driver boss 144 extends axially from the throughbore, and a plurality of tool-engagement notches 145 are formed along the top periphery of the driver boss 144. The driver boss 144 may be constructed as a hollow cylinder dimensioned to fit around the central hub 123 when assembled. The driver boss 144 and the tool-engagement notches 145 form a castellated structure, and the tool-engagement notches 145 are constructed to accept the working portion of a tool to facilitate rotation of the driver disk 143 about the central hub 123.

The cap 150 is similar to the cap 50 and includes a central bore 153 that slidably fits over the central hub 123. The central bore 153 is dimensioned to accommodate the thickness of the driver boss 144 so that the driver boss 144 can extend a predetermined distance along the central hub 123. Unlike the previously described cap 50, the cap 150 does not include an offset driver access hole 52.

In use, the user engages the notches 145 with a tool and rotates the driver disk 143. The driver disk 143 acts as a cam crank due to the offset disposition of the driver disk 143, and the rotation of the driver disk 143 forces the driver 141 to orbit about the central hub 123 and thereby simultaneously rotate the connected rotors 130. Since the rotation of the driver disk 143 is applied about a center axis of the overall structure of the simultaneous actuator 100, less force and difficulty is required to simultaneously rotate the rotors 130 due to a more even distribution of motive force.

Figure 7:
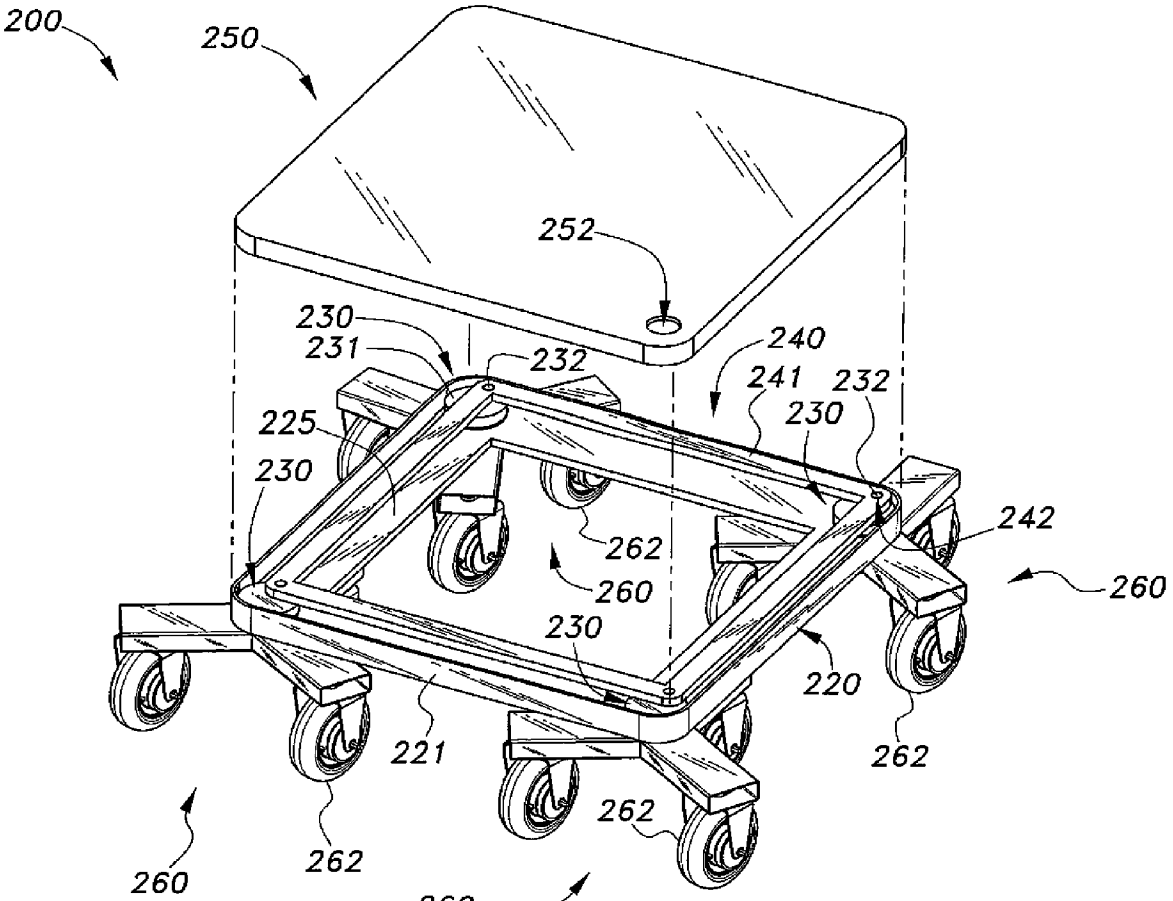
FIG. 7 is a perspective view of a third embodiment of a simultaneous actuating mechanism for parallel axis rotors according to the present invention.

A third embodiment of a simultaneous actuator 200 for parallel axis rotors is shown in FIG. 7. In this embodiment, the simultaneous actuator 200 facilitates simultaneous and synchronous operation of a plurality of sub-actuators in a chained configuration.

As shown, the simultaneous actuator 200 includes a housing 220, a plurality of rotors 230 rotatably mounted inside the housing 220, a driving assembly 240 coupled to the rotors 230 to drive the rotors 230 simultaneously, and a cap 250 detachably mounted to the housing 220. Each rotor 230 acts a sub-actuator to operate another assembly. In the embodiment shown in FIG. 7, the other assembly is a rolling assembly 260.

The housing 220 is constructed as a generally hollow, rectangular shell having a base 225 at one end of the housing 220 and an outer wall 221 extending from the base 225. The opposite end of the housing 220 is open. The outer wall 221 is generally rectangular to define the shape of the housing 220.

Each rotor 230 is a sub-actuator configured to operate or steer casters 262 in the corresponding rolling assembly 260. Each rotor 230 is generally constructed similar to the simultaneous actuator 10, and operation of the rotors or sub-rotors therein by the respective rotor 230 facilitates simultaneous and synchronous steering of the casters 262. Each rotor 230 includes a rotor housing 231 and an offset crank pin 232.

To facilitate simultaneous steering of the casters 262 in each rolling assembly 260, each rotor housing 231 can include, e.g., a plurality of sub-rotors corresponding to the number of casters 262. Each sub-rotor can be coupled to a respective caster 262 via tie-rods, chain belts, and the like in conventional steering systems to rotate the respective caster 262 in the desired direction by a corresponding rotation of the sub-rotor.

As with the previous embodiments, the driving assembly 240 facilitates concurrent rotation or actuation of all the rotors 230 inside the housing 220. The driving assembly 240 includes a driver 241 having a plurality of driver holes 242 formed therein. The driver 241 may be constructed as a rectangular ring dimensioned to fit inside the housing 220 with suitable space for movement. The size of the rectangular ring permits the rectangular ring to orbit about the geometric center of the housing 220. Each driver hole 242 is sized to receive a respective crank pin 232 therein when assembled. The crank pin 232 of each rotor 230 is placed at an offset from the axis of rotation of the corresponding rotor 230. Thus, when assembled, the orbital movement of the driver 241 about the geometric center forces all the connected crank pins 232 to rotate the respective rotor 230. In this embodiment, the rotors 232 are disposed near the corners of the housing 220.

Similar to the simultaneous actuator 10, the simultaneous actuator 200 can be provided with a cap 250 having a tool access hole 252 formed therein. Operation of the driver 241 can be facilitated by a tool or a mechanical assembly to selectively couple one or more of the crank pins 232 through the tool access hole 252. Positive rotation of one or more of the crank pins 232 causes the rest of the rotors 230 to simultaneously rotate due to their connection with the driver 241. Thus, it can be seen that the driving assembly 240 serves as the main driving system chained or coupled to one or more subsystems in the form of the rotors 230. In all other respects, the operation of the simultaneous actuator 200 is substantially the same as in the previously described embodiments.

Figure 8:
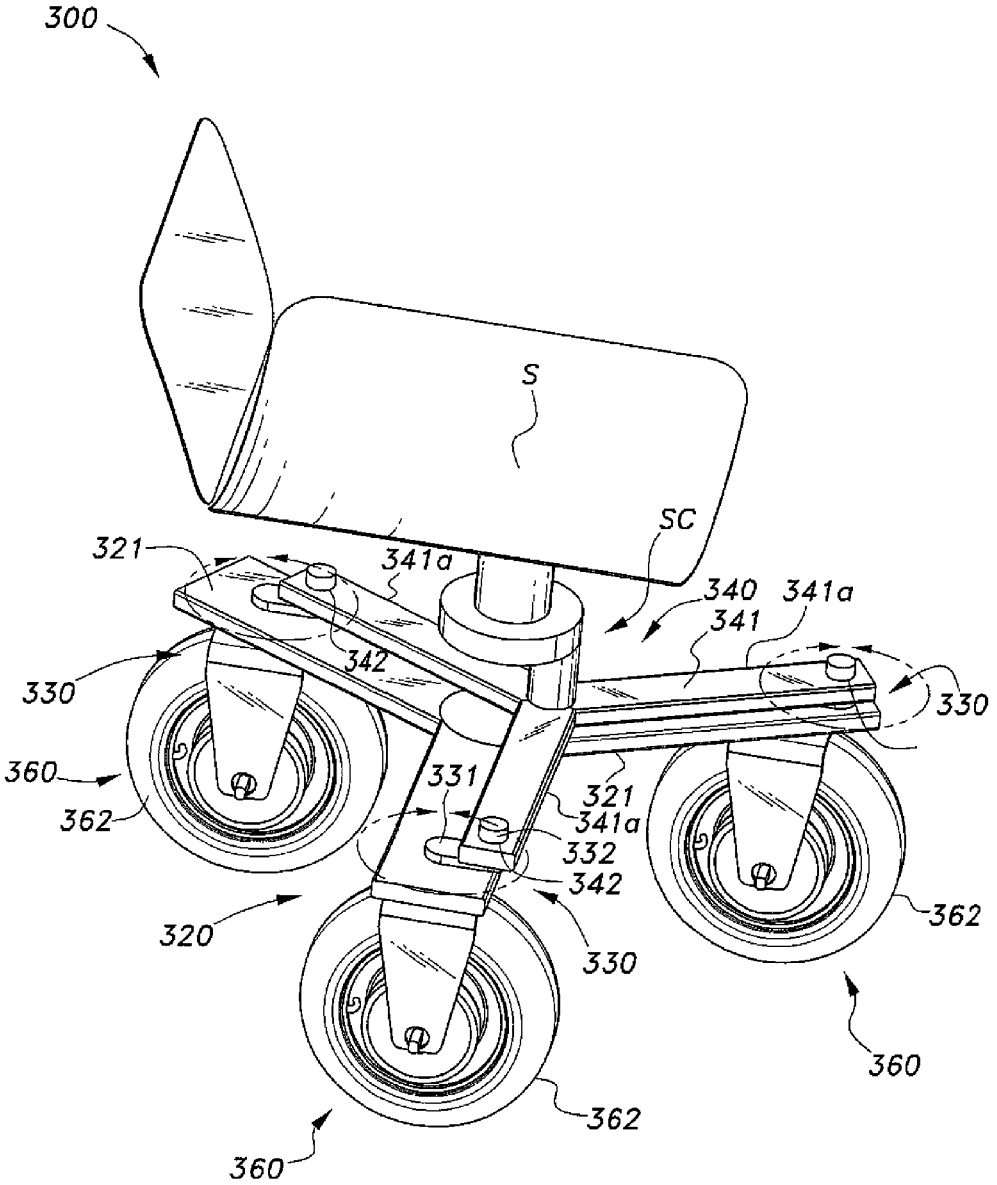
FIG. 8 is a perspective view of a fourth embodiment of a simultaneous actuating mechanism for parallel axis rotors according to the present invention.

A fourth embodiment of a simultaneous actuator 300 for parallel axis rotors is shown in FIG. 8. The simultaneous actuator 300 is an example of a steering controller for a plurality of rolling assemblies.

The simultaneous actuator 300 includes a base 320, a plurality of rotors 330 rotatably mounted on the base 320, and a driving assembly 340 coupled to the rotors 330 to drive the rotors 330 simultaneously. In the embodiment shown in FIG. 8, each rotor 330 is coupled to a respective rolling assembly 360.

The base 320 is constructed as a generally flat platform having a plurality of elongate base arms 321 radiating from the center thereof. Each rotor 330 is rotatably mounted to the distal end of each base arm 321. Each rotor 330 includes an elongate crank arm 331 and an eccentric crank pin 332 projecting upward from one end of the corresponding crank arm 331. The other end of the crank arm 331 is coupled to a corresponding rolling assembly 360. Each roller assembly 360 is preferably a caster 362, similar to the casters 262 in the previous embodiment.

The driving assembly 340 includes a driver 341 coupled to all the crank pins 332. The driver 341 is preferably constructed similarly to the base 320, having matching elongate, radiating driver arms 341*a* corresponding to the base arms 321. The driver arms 341*a* and the base arms 321 are also preferably equidistantly spaced. It is to be noted, however, that the shape and dimensions of the driver 341 can be varied, so long as the driver can be suitably coupled to the crank pins 332. The driver 341 is provided with one or more driver holes 342 near the distal end of each driver arm 341*a* for capturing a corresponding crank pin 332 therein.

The steering of the rolling assemblies 360 is facilitated by selective rotation of a seat S by the user. In use, a user sitting on the seat S rotates the seat S towards the desired direction of travel. The seat S is mounted to the driver 340 so that rotation of the seat S causes concurrent rotation of the driver 340 in the same direction. The connection of the seat S is near the geometric center or common point between the driver arms 341. To ease rotation of the driver 340, the connection of the seat S can be offset or eccentric to the geometric center of the driver 340 so that the seat S acts as an eccentric lever on the driver 340. Due to the interconnection between the crank pins 332 and the crank arms 331, rotation of the driver 340 enables simultaneous rotation of the rolling assemblies 360 to steer the rolling assemblies 360 towards the desired direction of travel.

It is to be understood that the simultaneous actuator 10, 100, 200 encompasses a variety of alternatives. For example, the rotors 30, 130, 230, 330 can be configured to operate radial reciprocating elements, such as in locking mechanisms. Moreover, the simultaneous actuator 10, 100, 200, 300 can be utilized in many mechanical systems that require multiple similar and dissimilar operations. The simultaneous operations afforded by the simultaneous actuator 10, 100, 200, 300 greatly reduce time and effort needed to operate such systems individually.

It is to be understood that the present invention is not limited to the embodiments described above, but encompasses any and all embodiments within the scope of the following claims.

We claim:

1. A simultaneous actuating mechanism for parallel axis rotors, comprising:

a housing, wherein the housing comprises:

a substantially hollow, cylindrical shell having a substantially closed base at one end of said housing, an outer wall extending from the base, and an opposite open end; and an elongate, hollow central hub extending axially from a center of the base, the outer wall and the central hub having a space between them defining an annular recess inside the housing, the plurality of rotors being mounted inside the annular recess;

a plurality of rotors mounted inside the housing at predefined spaced positions, each rotor having an axis of rotation and a crank pin disposed at an offset from the axis of rotation, the axes of rotation of the rotors being parallel to each other, wherein the plurality of rotors further comprise:

at least one rotor having a crank head, the crank pin of the at least one rotor extending axially from one side of the crank head; and an elongate threaded engagement post extending from the opposite side of the crank head, the engagement post defining the axis of rotation for the at least one rotor, the closed base of the housing having at least one hole to permit the engagement post to pass through when assembled; and a driving assembly coupled to the crank pins to simultaneously drive the rotors.

2. The simultaneous actuating mechanism for parallel axis rotors according to claim 1, wherein said driving assembly comprises:

a driver coupled to the crank pins of said rotors, the driver having a plurality of driver holes, each of the driver holes having a corresponding one of the crank pins extending therein, the driver being disposed around said central hub to orbit about said central hub during operation; and a power assembly coupled to the driver, the power assembly powering the driver to cause the driver to orbit inside said housing and simultaneously rotate said rotors.

3. The simultaneous actuating mechanism for parallel axis rotors according to claim 2, wherein said driver comprises an annular ring, the plurality of driver holes being formed in the annular ring.

4. The simultaneous actuating mechanism for parallel axis rotors according to claim 2, wherein said power assembly comprises:

a driver nut coupled to said driver, the driver nut having a through-hole to capture one of said crank pins therein;

an engagement boss extending from said driver nut, the engagement boss engaging an inner periphery of said driver during operation; and a tool boss extending from said driver nut, the tool boss having a tool recess for selective insertion and operation of a tool.

5. The simultaneous actuating mechanism for parallel axis rotors according to claim 4, further comprising:

a cap covering the open end of said housing;

a central bore formed in the cap, the central bore being dimensioned to slide over said central hub when assembled; and a driver access hole formed in the cap at a location offset from the central bore, the driver access hole facilitating access to said tool boss during operation.

6. The simultaneous actuating mechanism for parallel axis rotors according to claim 1, wherein said plurality of rotors comprises at least one pair of rotors having a predetermined, spaced distance between the at least one pair of rotors, the predetermined distance being constant during operation.

7. The simultaneous actuating mechanism for parallel axis rotors according to claim 1, wherein each said rotor has a crank length defined by a distance between the crank pin and the axis of rotation of said rotor, the crank length of each said rotor being equal.

8. A simultaneous actuating mechanism for parallel axis rotors, comprising:

a housing, wherein the housing comprises:

a substantially hollow, cylindrical shell having a substantially closed base at one end of said housing, an outer wall extending from the base, and an opposite open end; and an elongate, hollow central hub extending axially from a center of the base, the outer wall and the central hub having a space between them defining an annular recess inside the housing, the plurality of rotors being mounted inside the annular recess;

a plurality of rotors mounted inside the housing at predefined spaced positions, each rotor having an axis of rotation and a crank pin disposed at an offset from the axis of rotation, the axes of rotation of the rotors being parallel to each other; and a driving assembly coupled to the crank pins to simultaneously drive the rotors wherein the driving assembly comprises:

a driver coupled to the crank pins of the rotors, the driver having a plurality of driver holes, each of the driver holes having a corresponding one of the crank pins extending therein, the driver being disposed around said central hub to orbit about said central hub during operation; and a power assembly coupled to the driver, the power assembly powering the driver to cause the driver to orbit inside the housing and simultaneously rotate the rotors, wherein the power assembly comprises:

a driver nut coupled to the driver, the driver nut having a through-hole to capture one of the crank pins therein;

an engagement boss extending from the driver nut, the engagement boss engaging an inner periphery of the driver during operation; and a tool boss extending from the driver nut, the tool boss having a tool recess for selective insertion and operation of a tool.

* * * * *